US006661741B1

(12) United States Patent
Stottlemyer

(10) Patent No.: US 6,661,741 B1
(45) Date of Patent: Dec. 9, 2003

(54) OPTICAL HYDROPHONE AND ARRAY USING BUBBLE RESONANCE FOR DETECTING ACOUSTIC SIGNALS

(75) Inventor: Thomas R. Stottlemyer, Mystic, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/165,922

(22) Filed: Jun. 6, 2002

(51) Int. Cl.[7] ..... H04R 1/00

(52) U.S. Cl. ..... 367/149

(58) Field of Search ..... 367/149; 385/12, 385/13; 250/227.14

(56) References Cited

U.S. PATENT DOCUMENTS

2003/0072219 A1 * 4/2003 Ruffa ..... 367/149

* cited by examiner

*Primary Examiner*—Daniel T. Pihulic
(74) *Attorney, Agent, or Firm*—James M. Kasischke; Jean-Paul A. Nasser; Michael F. Oglo

(57) ABSTRACT

An optical hydrophone described herein includes a housing defining a chamber. The housing is acoustically transparent to acoustic waves at a frequency of interest. An optically transparent material fills the chamber and has air-filled voids defined therein that resonate within the material when an incoming acoustic wave impinges on the material. Light introduced into the material and passed therethrough is affected by the air-filled voids resonating within the material. Light is transmitted to and from the material by optical fibers which are coupled to the material on either side thereof. A plurality of these optical hydrophones can be configured in a linear array through which light is passed. Such linear arrays can be used to measure incoming acoustic signals.

15 Claims, 1 Drawing Sheet

OPTICAL HYDROPHONE AND ARRAY USING BUBBLE RESONANCE FOR DETECTING ACOUSTIC SIGNALS

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to optical hydrophones, and more particularly to an optical hydrophone in which light transmission through a material incorporating air-filled voids or bubbles is affected by the acoustic induced resonance of the air-filled voids or bubbles, the affected light beam serving as a means for measuring the acoustic waves causing such resonance.

(2) Description of the Prior Art

Towed acoustic receiver arrays are used in military and civilian applications to detect acoustic signals in the water. Traditional towed acoustic receiver arrays take the form of linear arrays of hydrophones mounted inside a flexible hose, the array being connected to a towing vessel by a tow cable. Although the data from these hydrophones may be transmitted through the tow cable optically, the measurement of the sound pressure levels is done electro-mechanically. More recently, innovative arrays developed for U.S. Navy applications use optical fibers wound around mandrels to detect sound. However, arrays made from either electromechanical hydrophones or mandrel-wound optical fiber hydrophones are fairly large in diameter. This leads to the use of larger, heavier and more expensive handling equipment (e.g., winches, motors and storage reels) for the storage, deployment and retrieval of the towed acoustic receiver array.

SUMMARY OF THE INVENTION

Accordingly, it is an object of the present invention to provide a linear hydrophone array that is small in diameter.

Another object of the present invention is to provide a hydrophone for use in a towed acoustic receiver array.

Still another object of the present invention is to provide a linear hydrophone array that is small in diameter.

Other objects and advantages of the present invention will become more obvious hereinafter in the specification and drawings.

In accordance with the present invention, an optical hydrophone includes a housing defining a chamber. The housing is acoustically transparent to acoustic waves at a frequency of interest. An optically transparent material fills the chamber and has air-filled voids (e.g., bubbles in the material, air-filled microspheres, etc.) defined therein that expand and collapse thus resonating within the material when the acoustic waves impinge on the material. Light is introduced into the material (e.g., a light source such as a light transmitting optical fiber) and passed therethrough. The light passed through the material is received/detected where the light passed through the material is affected by the air-filled voids resonating within the material. In terms of an optical hydrophone array, the light passed through the material is transferred into another optical fiber and then along the array of hydrophones. The array must be calibrated prior to use in order to measure the amount of light attenuation for a given acoustic signal level.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
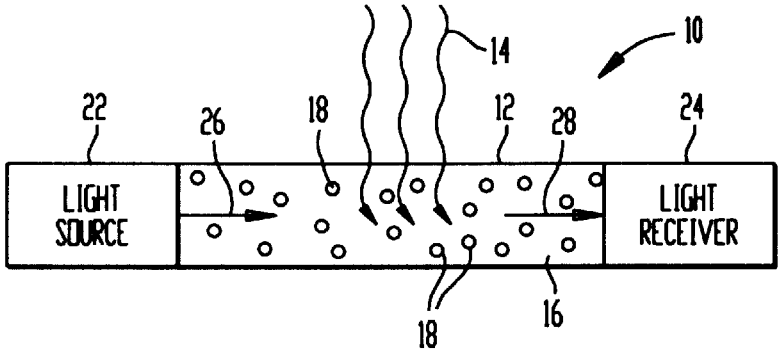
FIG. 1 is a schematic view of an optical hydrophone according to the present invention.

Referring now to the drawings, and more particularly to FIG. 1, a schematic view of an optical hydrophone in accordance with the present invention is shown and referenced generally by numeral 10. Optical hydrophone 10 will be used to explain the novel features and operating principles of the present invention. It will be readily understood by one of ordinary skill in the art that the features and operating principles disclosed herein can be practiced/realized by a wide variety of structural embodiments thereof without departing from the scope of the present invention. Accordingly, the embodiments to be described later below are provided as non-limiting examples of the present invention's features and operating principles.

Figure 2:
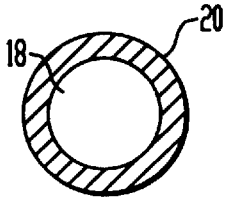
FIG. 2 is a cross-sectional view of a microsphere that can be used to realize the air-filled voids in the present invention.

Optical hydrophone 10 includes a housing 12 selected to be acoustically transparent with respect to incoming acoustic waves 14. That is, housing 12 is a material that acoustically transparent (e.g., plastic, stiff rubber, etc.) across a broad frequency range or a narrower frequency range of interest. Housing 12, or some portion thereof, defines a chamber filled with a material 16 that, in general, is optically transparent. Defined within material 16 are a number of air-filled voids 18 that can be air-pockets or bubbles in suspension within material 16. Each air-filled void 18 could also be independently and positively defined by means of a microsphere 20 illustrated cross-sectionally in FIG. 2.

Material 16 is selected such that when acoustic waves 14 impinge thereon, air-filled voids 18 resonate within material 16. To provide for such resonation, material 16 is typically a viscous liquid or gel, e.g., castor oil, glycerin, clear gels or jellies, etc. Note that if a liquid is used for material 16, it may be necessary to make air-filled voids 18 neutrally-buoyant structures (i.e., via the use of air-filled microspheres 20).

Coupled to material 16 are a light source 22 and a light receiver 24. Typically, light source 22 and light receiver 24 will be disposed opposite one another with material 16 being disposed therebetween. In operation, light source 22 transmits light (referenced by arrow 26) into material 16. The amount of light 26 passing through material 16 will be affected by the resonance (i.e., expansion and contraction) of air-filled voids 18, the amplitude and frequency of which is proportional the amplitude and frequency of acoustic waves 14. Light (referenced by arrow 28) reaching light receiver 24 is altered relative to transmitted light 26 in proportion to the amplitude and frequency of resonating air-filled voids 18. The size of air-filled voids 18 and the volume fraction thereof within material 16 can be used to tune optical hydrophone 10 to be sensitive to a particular frequency range and amplitude level of incoming acoustic waves 14.

Figure 3:
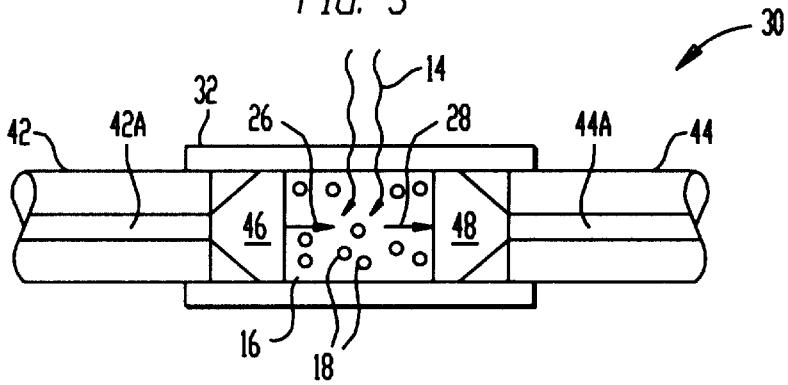
FIG. 3 is a side view of an embodiment of an optical hydrophone according-to the present invention that is suitable for use in a towed acoustic receiver array.

As mentioned above, the novel features and operating principles presented by optical hydrophone 10 can be realized in a variety of structures. By way of non-limiting example, one such structure is illustrated in FIG. 3 and is referenced generally by numeral 30 where like reference numerals are used for the elements common both of hydrophones 10 and 30.

In general, optical hydrophone 30 utilizes optical fibers to transmit light into material 16 and to receive light passing through material 16. More specifically, a fiber optic alignment sleeve 32 has optical fibers 42 and 44 fitted in either end thereof. Such fiber optic alignment sleeves are well known in the act. By way of illustrative example, optical fiber 42 transmits light to material 16 while optical fiber 44 receives light from material 16. However, it is to be understood that this order can be reversed.

Sleeve 32 is made from a material that is acoustically transparent to acoustic waves 14 and is stiff enough to maintain alignment of lenses 46 and 48. To achieve these functions, sleeve 32 is typically made of plastic or a stiff rubber. Each of optical fibers 42 and 44 has an optical fiber core 42A and 44A, respectively, for transmitting light therealong. Since optical fiber cores 42A and 44A are very small in diameter, it may be desirable to expand the light beam passing through material 16 to increase the cross-sectional area of the light exposed to the resonance of air-filled voids 18. For example, a diverging lens 46 can be coupled to the terminal end of optical fiber core 42A and a converging lens 48 can be coupled to the terminal end of optical fiber core 44A. To utilize the full diameter of sleeve 32, lenses 46 and 48 can span the full interior diameter of sleeve 32 as shown. The spacing or gap between lenses 46 and 48 is filled with material 16. Operation of optical hydrophone 30 is the same as optical hydrophone 10, i.e., light 26 is transmitted into material 16 and is affected by resonating air-filled voids 18 to yield acoustically affected light 28.

Figure 4:
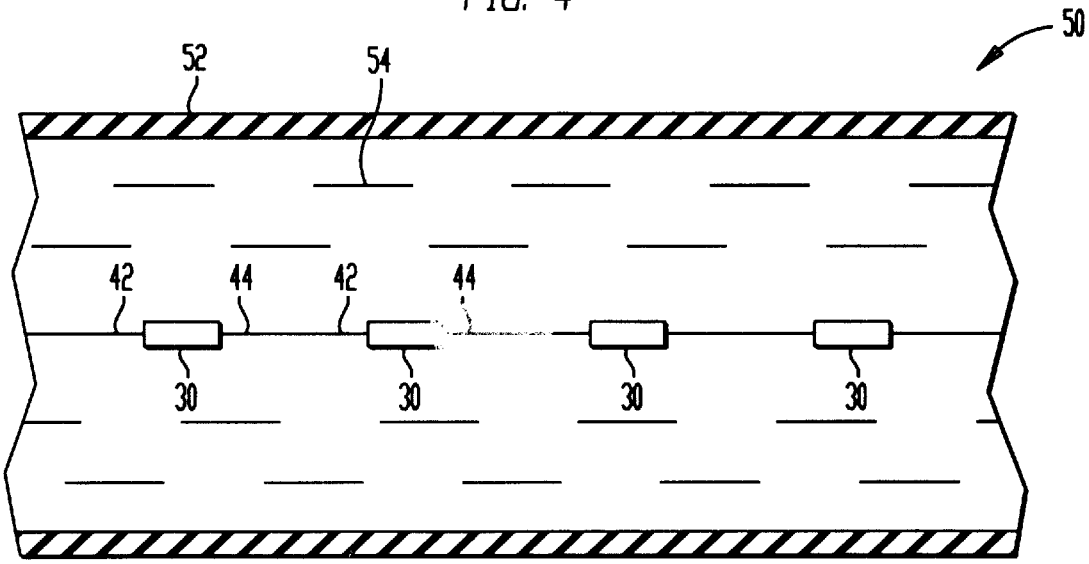
FIG. 4 is a side view of a towed acoustic receiver array that uses the optical hydrophone depicted in FIG. 3.

Optical hydrophone 30 can be used as the basic hydrophone element for a towed acoustic receiver array 50 illustrated in FIG. 4. By way of non-limiting example, array 50 can be constructed with an outer flexible hose 52 (which can be reinforced with strength members) that is typically filled with oil 54 to protect each hydrophone 30 and reduce self-noise problems that occur due to flow noise. Note that the "receiving" optical fiber 44 for each hydrophone 30 becomes the "transmitting" optical fiber 42 for the next successive hydrophone 30.

The advantages of the present invention are numerous. The optical hydrophone can be very small in diameter since it can be based on the diameter of an optical fiber. As a result, a towed acoustic receiver array constructed from the optical fiber-based embodiment of the present invention will yield a small diameter towed array. The reduction in overall size and weight of the towed array means that shipboard handling equipment can be smaller, lighter and, therefore, less expensive than current towed array handling systems.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An optical hydrophone, comprising:

a housing defining a chamber, said housing being acoustically transparent to incoming acoustic waves at a frequency of interest;

an optically transparent material filling said chamber, said material having a plurality of air-filled voids, each of which is surrounded by a microsphere, wherein said air-filled voids resonate within said material when said acoustic waves impinge on said material;

first means coupled to said material for transmitting light therein, wherein said light passes therethrough; and second means coupled to said material for receiving said light passed therethrough, wherein said light passed through said material is affected by said air-filled voids resonating within said material.

2. An optical hydrophone as in claim 1 wherein said first means comprises:

a light source for generating said light;

an optical fiber having a first end coupled to said light source and having a second end, said optical fiber transmitting said light from said first end to said second end; and means for coupling said second end of said optical fiber to said material.

3. An optical hydrophone as in claim 2 wherein said material and said optical fiber have an index of refraction that is approximately equal.

4. An optical hydrophone as in claim 1 wherein said second means comprises:

a light receiver for receiving said light passed through said material;

an optical fiber having a first end coupled to said light receiver and having a second end; and means for coupling said second end of said optical fiber to said material, wherein said optical fiber transmits said light passed through said material from said second end to said first end.

5. An optical hydrophone as in claim 4 wherein said material and said optical fiber have an index of refraction that is approximately equal.

6. An optical hydrophone as in claim 1 wherein said first means comprises:

a light source for generating said light;

a first optical fiber having a first end coupled to said light source and having a second end, said first optical fiber transmitting said light from said first end thereof to said second end thereof; and a first lens for coupling said second end of said first optical fiber to said material.

7. An optical hydrophone as in claim 6 wherein said second means comprises:

a light receiver for receiving said light passed through said material;

a second optical fiber having a first end coupled to said light receiver and having a second end; and a second lens for coupling said second end of said second optical fiber to said material, wherein said second optical fiber transmits said light passed through said material from said second end thereof to said first end thereof.

8. An optical hydrophone as in claim 7 wherein said material, said first optical fiber and said second optical fiber have an index of refraction that is approximately equal.

9. An optical hydrophone, comprising:

a sleeve having a first end and a second end, said sleeve being acoustically transparent to incoming acoustic waves at a frequency of interest;

a first optical fiber having a terminal end thereof fitted in said first end of said sleeve;

a first lens coupled to said terminal end of said first optical fiber;

a second optical fiber having a terminal end thereof fitted in said second end of said sleeve;

a second lens coupled to said terminal end of said second optical fiber, wherein said first lens and said second lens are spaced apart from one another by a gap; and an optically transparent material filling said gap, said material having air-filled voids defined therein that resonate within said material when said acoustic waves impinge on said material.

10. An optical hydrophone as in claim 9 wherein each of said air-filled voids is surrounded by a microsphere.

11. An optical hydrophone as in claim 9 wherein each of said air-filled voids is a bubble in said material.

12. An optical hydrophone as in claim 9 wherein said material, said first optical fiber and said second optical fiber have an index of refraction that is approximately equal.

13. An optical hydrophone array, comprising:

a plurality of optical hydrophones, each of said plurality of optical hydrophones comprising i) a housing defining a chamber, said housing being acoustically transparent to incoming acoustic waves at a frequency of interest, ii) an optically transparent material filling said chamber, said material having air-filled voids defined therein that resonate within said material when said acoustic waves impinge on said material, iii) first means coupled to said material for transmitting light therein, wherein said light passes therethrough, and iv) second means coupled to said material for receiving said light passed therethrough, wherein said light passed through said material is affected by said air-filled voids resonating within said material; and said second means of each of said plurality of optical hydrophones being optically coupled to said first means of a subsequent one of said plurality of optical hydrophones.

14. An optical hydrophone array as in claim 13 wherein each of said air-filled voids is surrounded by a microsphere.

15. An optical hydrophone array as in claim 13 wherein each of said air-filled voids is a bubble in said material.

* * * * *